US010332655B1

(12) United States Patent
Sugiyama

(10) Patent No.: US 10,332,655 B1
(45) Date of Patent: Jun. 25, 2019

(54) DIFFERENTIAL SIGNAL CABLE ASSEMBLY

(71) Applicant: HITACHI METALS, LTD., Tokyo (JP)

(72) Inventor: Takahiro Sugiyama, Tokyo (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 16/202,679

(22) Filed: Nov. 28, 2018

(30) Foreign Application Priority Data

Dec. 1, 2017 (JP) ..... 2017-231888

(51) Int. Cl.

| | |
|---|---|
| ***H01B 11/20*** | (2006.01) |
| ***H01R 13/6592*** | (2011.01) |
| ***H01B 11/18*** | (2006.01) |
| ***H01B 3/44*** | (2006.01) |
| ***H01B 7/02*** | (2006.01) |

(52) U.S. Cl.
CPC ..... *H01B 11/20* (2013.01); *H01B 3/445* (2013.01); *H01B 7/0216* (2013.01); *H01B 11/1895* (2013.01); *H01R 13/6592* (2013.01)

(58) Field of Classification Search
CPC ..... H01B 11/20; H01B 3/445; H01B 7/0216; H01B 11/1895; H01B 13/6592
USPC ..... 174/74 R
See application file for complete search history.

(56) References Cited

U.S. PATENT DOCUMENTS

| | | | | |
|---|---|---|---|---|
| 5,057,650 | A * | 10/1991 | Urushibata | H01R 12/613 174/72 A |
| 7,520,757 | B2 * | 4/2009 | Bartholomew | H05K 1/0219 439/76.1 |
| 8,696,378 | B2 * | 4/2014 | Behziz | H01R 12/53 439/497 |
| 8,841,554 | B2 * | 9/2014 | Gundel | H01B 7/0838 174/102 R |
| 9,373,915 | B1 * | 6/2016 | Schulz | H01R 13/6594 |
| 9,640,880 | B2 * | 5/2017 | Tran | H01R 9/035 |
| 2014/0014409 | A1 * | 1/2014 | Lin | H02G 15/08 174/75 R |
| 2014/0349496 | A1 * | 11/2014 | Zhu | H05K 1/0219 439/108 |
| 2016/0276757 | A1 * | 9/2016 | Smith | H01C 21/50 |
| 2017/0194751 | A1 | 7/2017 | Little et al. | |

* cited by examiner

*Primary Examiner* — Timothy J Thompson
*Assistant Examiner* — Michael F McAllister
(74) *Attorney, Agent, or Firm* — Scully, Scott, Murphy & Presser, PC

(57) ABSTRACT

A differential signal cable assembly includes a connector to be connected to a communication device, a first multi-pair cable that is connected to the connector at one end and includes a plurality of first differential signal cables for transmitting differential signals, a second multi-pair cable that includes a plurality of second differential signal cables having a larger conductor diameter than the first differential signal cables, and a connection that is connected to an other end of the first multi-pair cable and one end of the second multi-pair cable such that each of the first differential signal cables is electrically connected to a corresponding one of the second differential signal cables.

8 Claims, 6 Drawing Sheets

DIFFERENTIAL SIGNAL CABLE ASSEMBLY

The present application is based on Japanese patent application No. 2017-231888 filed on Dec. 1, 2017, the entire contents of which are incorporated herein by reference.

BACKGROUND OF THE INVENTION

1. Field of the Invention

The invention relates to a differential signal cable assembly.

2. Description of the Related Art

A differential signal cable assembly is known which is provided with a multi-pair cable having plural differential signal cables for transmitting differential signals and connectors provided at both ends of the multi-pair cable (see, e.g., US 2017/0194751).

It is known that in some differential signal cable assemblies, connectors having substantially the same shape as an optical transceiver module are used. For example, in a differential signal cable assembly having connectors compliant with the QSFP (Quad Small Form-factor Pluggable) standard, a multi-pair cable having eight differential signal cables is used to support four transmit and receive channels. Regarding the number of the differential signal cables, it is sometimes expressed as 1-pair, 2-pair . . . , 8-pair, and so on since each differential signal cable has two cores (signal lines).

SUMMARY OF THE INVENTION

Along with an increase in channel capacity in recent years, it is required to increase the number of available transmit and receive channels per differential signal cable assembly. In recent years, a technique allowing for transmission/reception with eight channels, called QSFP-DD, is under development and there is a demand for a differential signal cable assembly capable of transmission/reception with not less than eight channels.

However, an increase in size of connector is not desirable in view of achieving higher density and larger capacity even if more channels can be provided. According to the QSFP-DD standard mentioned above, the size of connector is substantially the same as that specified in the QSFP standard, which means that sixteen differential signal cables need to be connected to a connector having substantially the same size as before.

Thus, differential signal cables having a smaller conductor diameter than before have to be used. However, differential signal cables having a small conductor diameter have large losses (attenuation of signals) and a transmission distance thus needs to be short.

It is an object of the invention to provide a differential signal cable assembly that has a sufficient transmission distance even when the number of channels is increased.

According to an embodiment of the invention, a differential signal cable assembly comprise:

a connector to be connected to a communication device;

a first multi-pair cable that is connected to the connector at one end and comprises a plurality of first differential signal cables for transmitting differential signals;

a second multi-pair cable that comprises a plurality of second differential signal cables having a larger conductor diameter than the first differential signal cables; and a connection that is connected to an other end of the first multi-pair cable and one end of the second multi-pair cable such that each of the first differential signal cables is electrically connected to a corresponding one of the second differential signal cables.

Effects of the Invention

According to an embodiment of the invention, a differential signal cable assembly can be provided that has a sufficient transmission distance even when the number of channels is increased.

BRIEF DESCRIPTION OF THE DRAWINGS

Next, the present invention will be explained in more detail in conjunction with appended drawings, wherein:

FIGS. 4A and 4B are diagrams illustrating the connection, wherein FIG. 4A is a plan view in which a connection case and a connection shield member are omitted and FIG. 4B is a side view in which the connection case and the connection shield member are shown as the cross section;

FIGS. 5A and 5B are diagrams illustrating a differential signal cable assembly in a modification of the invention, wherein FIG. 5A is a perspective view and FIG. 5B is a cross sectional view taken on line A-A of FIG. 5A.

DETAILED DESCRIPTION OF THE PREFERRED EMBODIMENTS

Embodiment

An embodiment of the invention will be described below in conjunction with the appended drawings.

General Configuration of Differential Signal Cable Assembly

Figure 1:
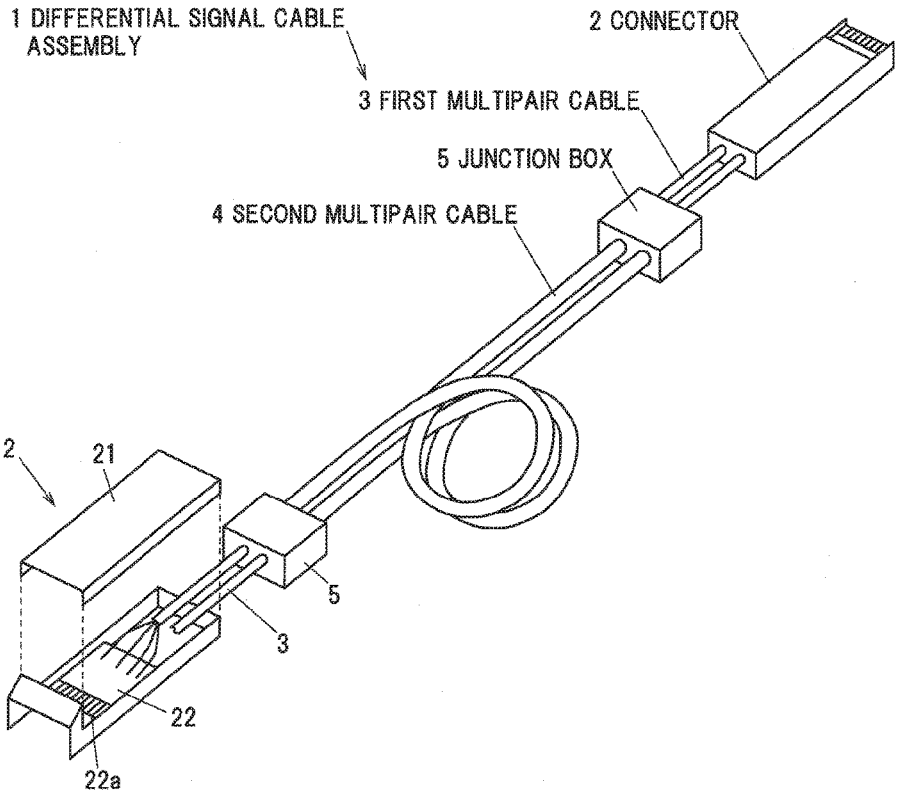
FIG. 1 is a perspective view showing a differential signal cable assembly in an embodiment of the present invention.

FIG. 1 is a perspective view showing a differential signal cable assembly (hereinafter, simply referred to as "cable assembly") in the present embodiment. A cable assembly 1 is provided with connectors 2 to be connected to a communication device, first multi-pair cables 3 connected to the connectors 2, second multi-pair cables 4, and connections 5 which connect the first multi-pair cables 3 to the second multi-pair cables 4.

The connector 2 is, e.g., a pluggable module connector compliant with the QSFP-DD standard. The connector 2 has a connector housing 21 and a connector substrate 22 housed in the connector housing 21. A card edge connector portion 22*a* formed by aligning electrodes is provided at an edge of the connector substrate 22.

For connection between the connectors 2 in the cable assembly 1 of the present embodiment, the first multi-pair cables 3 having a relatively small conductor diameter (small outer diameter) are used only at portions close to the connectors 2 and the second multi-pair cables 4 having a relatively large conductor diameter (large outer diameter) are used at the other portion. In other words, in the cable assembly 1, the long second multi-pair cables 4 having large outer diameter and conductor diameter and suitable for long distance transmission are connected to the connectors 2 via the short first multi-pair cables 3 having small outer diameter and conductor diameter.

The first multi-pair cables 3 used as connection to the connectors 2 have small outer diameter and conductor diameter and thus can be connected to the small connectors 2 even when the number of channels is increased. Use of only the first multi-pair cables 3 having a small conductor diameter does not allow a sufficient transmission distance to be ensured due to large a loss, but since the second multi-pair cables 4 having a large conductor diameter are used at the middle portion of the cable, it is possible to ensure a sufficient transmission distance. Furthermore, the cable in the vicinity of the connectors 2 can be bent easily, which facilitates cable laying work. Next, each component of the differential signal cable assembly 1 will be described in detail.

First Multi-Pair Cable 3

The first multi-pair cable 3 is connected to the connector 2 at one end and to the connection 5 at the other end. In this example, two 8-pair first multi-pair cables 3 each having eight first differential signal cables 30 for transmitting differential signals are used to support transmission/reception with eight channels. However, the number of first differential signal cables 30 contained in the first multi-pair cable 3 and the number of the first multi-pair cables 3 to be used are not limited thereto. For example, one 16-pair first multi-pair cable 3 may be used.

Figure 2A:
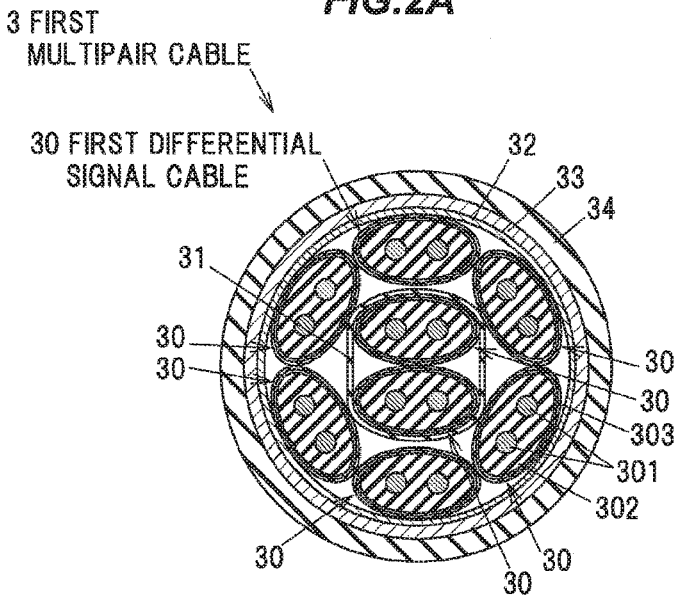
FIG. 2A is a cross sectional view showing a first multi-pair cable.

FIG. 2A is a cross sectional view showing the first multi-pair cable 3. In the first multi-pair cable 3, a tape-shaped separator 31 is wound around two twisted first differential signal cables 30 and six other first differential signal cables 30 are spirally twisted therearound, as shown in FIG. 2A. The first multi-pair cable 3 also has a shielding tape 32 wound around all the eight first differential signal cables 30, braided wires 33 covering the shielding tape 32, and a jacket 34 covering the braided wires 33. All the plural first differential signal cables 30 are shielded by the shielding tape 32 and the braided wires 33.

Materials used to form general cables can be used as the respective materials of the shielding tape 32, the braided wires 33 and the jacket 34. The separator 31 is formed of, e.g., paper, yarn or foam. The foam is, e.g., polyolefin foam such as polypropylene foam or ethylene foam.

The first differential signal cable 30 has a pair of first signal lines 301, a first insulation 302 covering the pair of first signal lines 301, and a first shield 303 covering the first insulation 302.

The first signal line 301 is a conductor wire formed of copper, etc., and transmits a differential signal. The pair of first signal lines 301 are covered with the single first insulation 302. In other words, the first differential signal cable 30 has a two cores-in-one coating structure.

Based on the study by the present inventor, the conductor diameter of the first signal line 301 needs to be at least not more than 30 AWG (American Wire Gauge) (not more than 0.254 mm) in order to be connectable to the connector 2 compliant with the QSFP-DD standard. In this regard, however, even when the conductor diameter is 30 AWG, connection is not possible unless the first differential signal cable 30 is largely squashed. Therefore, the conductor diameter of the first signal line 301 is preferably not more than 0.2 mm, more preferably, not more than 34 AWG (not more than 0.16 mm). In the present embodiment, the conductor diameter of the first signal line 301 is 34 AWG Characteristic impedance needs to a predetermined value. Thus, the smaller the conductor diameter, the smaller the outer diameter (the size) of the first differential signal cable 30 and the outer diameter of the entire first multi-pair cable 3. In other words, the conductor diameter and the outer diameter of the first differential signal cable 30 have a positive correlation, and when the conductor diameter is determined, the outer diameter of the first differential signal cable 30 is automatically determined. Therefore, in the present embodiment, the size of the first differential signal cable 30 is determined based on the conductor diameter.

The first insulation 302 has an elliptical shape or an racetrack shape (a shape formed of two parallel straight lines of the same length and semi-circular arcs connecting ends of the two straight lines, a rounded rectangular shape) in cross-section so that a major axis direction thereof coincides with an alignment direction of the first signal lines 301 and the center in the major and minor axis directions coincide with the center point of a line segment connecting between the centers of the first signal lines 301. In this example, the first insulation 302 is formed in an elliptical shape.

It is possible to use the first insulation 302 formed of, e.g., an insulating material such as polyethylene, polytetrafluoroethylene (PTFE) or tetrafluoroethylene-hexafluoropropylene copolymer (FEP). It is also possible to use the first insulation 302 formed of a foamed insulating material such as polyethylene foam. The first insulation 302 having a permittivity of about 1.5 to 3 can be used.

Furthermore, to facilitate installation to the connector substrate 22, it is possible to use the first insulation 302 formed of a fluorine resin such as Teflon (registered trademark). Use of fluorine resin for a long cable is not realistic since it is expensive. However, since the first multi-pair cables 3 are short in the present embodiment, an increase in the cost can be relatively small even when using the first insulation 302 formed of fluorine resin. By using a fluorine resin to form the first insulation 302, heat resistance of the first insulation 302 is improved and the first insulation 302 is less likely to melt by heat during soldering to the connector substrate 22, allowing, e.g., plural first signal lines 301 to be connected at a time by soldering and thereby facilitating connection work to the connector 2. It is very effective to improve workability particularly in case that the connector 2 is compliant with the QSFP-DD standard, etc., since many first differential signal cables 30 need to be connected to the small connector 2.

The first shield 303 is formed by winding a shielding tape around the first insulation 302. The shielding tape has a conductor layer and an insulation layer formed on one surface of the conductor layer even though it is not shown in the drawing. A strip-shaped conductive metal foil such as copper foil or aluminum foil can be used as the conductor layer, and an insulating resin such as polyester can be used as the insulation layer. A copper-polyester tape formed by providing a polyester insulation layer on one surface of a copper conductive layer is used in this example.

The first shield 303 is desirably formed by spirally winding (spirally wrapping) a shielding tape around the first insulation 302. This allows for easier bending as compared to when longitudinally wrapping the shielding tape. In addition, it is difficult to manufacture a thin first differential signal cable 30 when employing longitudinal wrapping due to extensibility of the shielding tape, but it is easy to manufacture a thin first differential signal cable 30 when spirally winding the shielding tape.

In case that the shielding tape is spirally wound, it is known that a phenomenon called suck-out, which is significant attenuation of differential signal, occurs in a specific high-frequency region. Thus, the length of the first multi-pair cable 3 is adjusted to the extent that the effect of suck-out does not cause any problem. In detail, the length of the first multi-pair cable 3 is preferably not more than 30 cm, more preferably, not more than 20 cm.

Second Multi-Pair Cable 4

Figure 2B:
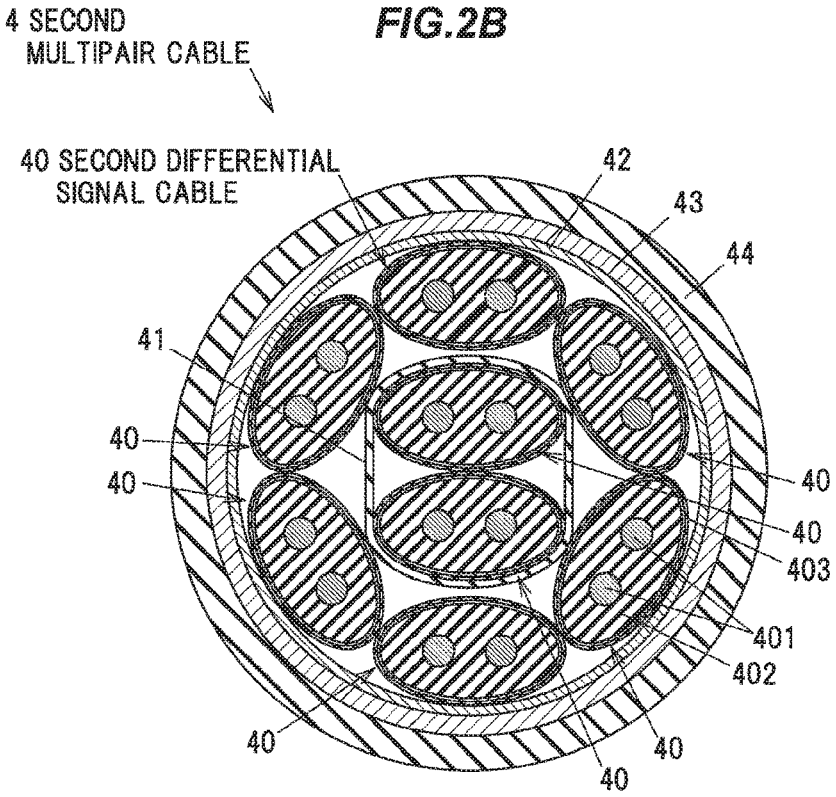
FIG. 2B is a cross sectional view showing a second multi-pair cable.

FIG. 2B is a cross sectional view showing the second multi-pair cable 4. As shown in FIG. 2B, the second multi-pair cable 4 has substantially the same structure as the first multi-pair cable 3.

That is, in the second multi-pair cable 4, a tape-shaped separator 41 is wound around two twisted second differential signal cables 40 and six other second differential signal cables 40 are spirally twisted therearound. The second multi-pair cable 4 also has a shielding tape 42 wound around all the eight second differential signal cables 40, braided wires 43 covering the shielding tape 42, and a jacket 44 covering the braided wires 43.

The second differential signal cable 40 has a pair of second signal lines 401, a second insulation 402 covering the pair of second signal lines 401, and a second shield 403 covering the second insulation 402. The materials of the second signal line 401, the second insulation 402 and the second shield 403 are the same as those used for the first multi-pair cable 3 and the explanation thereof is omitted. However, use of an expensive fluorine resin to form the second insulation 402 is not preferable since the second multi-pair cable 4 is long.

The conductor diameter of the second signal line 401 is larger than that of the first signal line 301. In view of increasing a transmission distance, the conductor diameter of the second signal line 401 is desirably as large as possible. In detail, the conductor diameter of the second signal line 401 is preferably not less than 0.4 mm, more preferably, not less than 26 AWG (not less than 0.404 mm). In addition, a difference between the conductor diameter of the second signal line 401 and the conductor diameter of the first signal line 301 is desirably not less than 1.5 mm.

To prevent the suck-out mentioned above, the second shield 403 is formed by longitudinally wrapping a shielding tape around the second insulation 402. This suppresses the effect of suck-out in the second multi-pair cable 4 and allows for transmission of, e.g., not less than 25 Gbit/s (gigabit per second).

Connection 5

The connection 5 is provided for electrically connecting each first differential signal cable 30 of the first multi-pair cable 3 to the corresponding second differential signal cable 40 of the second multi-pair cable 4.

Figure 3:
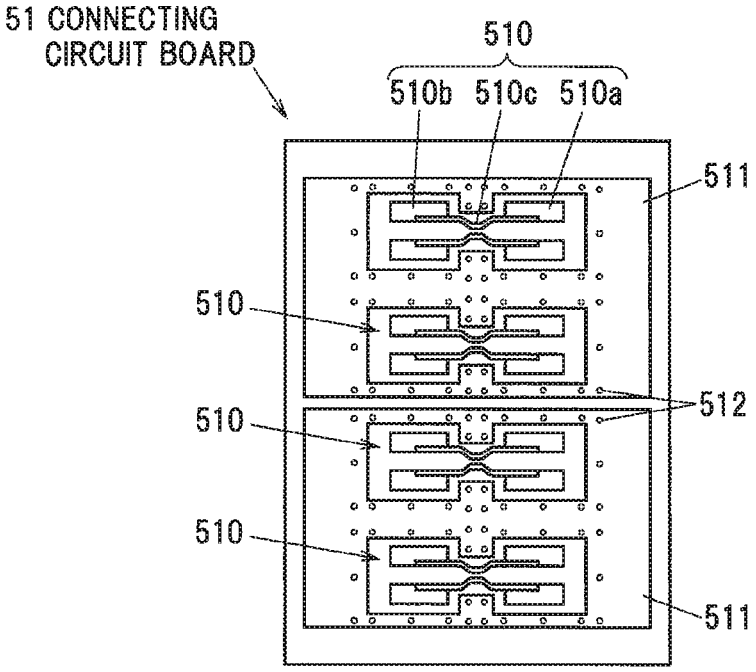
FIG. 3 is a plan view showing a connecting circuit board used in a connection.
Figure 4A:
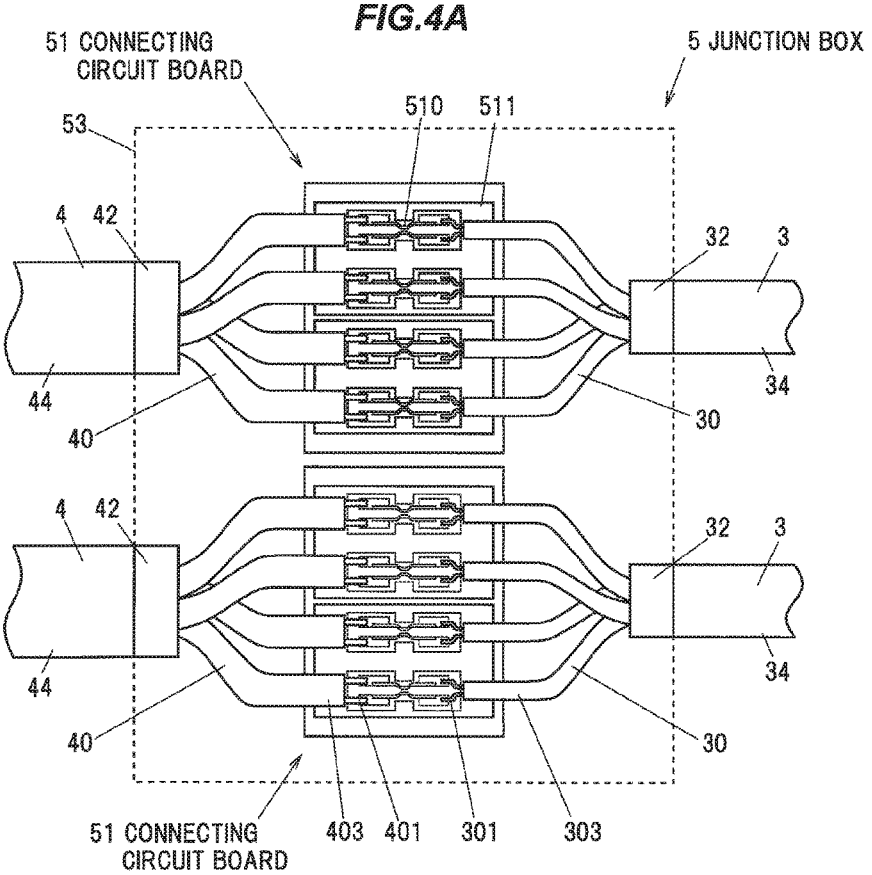
Figure 4B:
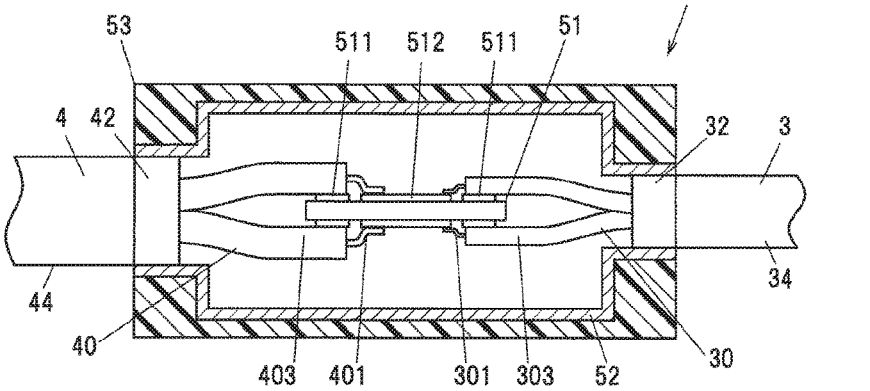

FIG. 3 is a plan view showing a connecting circuit board used in the connection 5. FIGS. 4A and 4B are diagrams illustrating the connection 5, wherein FIG. 4A is a plan view in which a connection case and a connection shield member are omitted and FIG. 4B is a side view in which the connection case and the connection shield member are shown as the cross section.

The connection 5 has connecting circuit boards 51 on which the first differential signal cables 30 are connected to the second differential signal cables 40, a connection shield member 52 surrounding the connecting circuit boards 51, and a connection case 53 housing the connecting circuit boards 51 and the connection shield member 52. In the present embodiment, the connection 5 has two connecting circuit boards 51 each of which connects one first multi-pair cable 3 (eight first differential signal cables 30) to one second multi-pair cable 4 (eight second differential signal cables 40). The connection shield member 52 and the connection case 53 are provided to surround both the two connecting circuit boards 51.

The connecting circuit board 51 has signal patterns 510 connecting the signal lines 301 and 401 of the first differential signal cables 30 and the second differential signal cables 40 to each other, and ground patterns 511 connecting the shields 303 and 403 of the first differential signal cables 30 and the second differential signal cables 40 to each other.

The signal pattern 510 has first electrodes 510*a* to which the first signal lines 301 are soldered, second electrodes 510*b* to which the second signal lines 401 are soldered, and connecting portions 510*c* electrically connecting the both electrodes 510*a* and 510*b* to each other. The ground pattern 511 is formed in a rectangular frame shape surrounding the signal patterns 510. The shields 303, 403 of the both differential signal cables 30, 40 are soldered to the ground pattern 511.

Although only the front surface of the connecting circuit board 51 is shown in FIG. 3, the same patterns 510 and 511 are formed on the back surface (see FIG. 4B). The ground patterns 511 on the front and back surfaces of the connecting circuit board 51 are electrically connected by multiple through-holes 512. Four pairs of differential signal cables 30 and 40 are connected to each of the front and back surfaces of the connecting circuit board 51. In addition, the differential signal cables 30, 40 for transmission and reception of the same channel are arranged to face each other with the connecting circuit board 51 sandwiched therebetween.

In the present embodiment, the two split ground patterns 511 are provided on the front and back surface of the connecting circuit board 51. This is because if an area of the ground pattern 511 is too large, heat applied during soldering is likely to escape through the ground pattern 511 and soldering workability decreases. By providing the split ground patterns 511, it is possible to promptly raise the temperature when heating, thereby improving soldering workability.

Although one ground pattern 511 is allocated for two channels (two pairs of differential signal cables 30, 40 to be soldered) in the present embodiment, one ground pattern 511 may be allocated for each channel (each pair of differential signal cables 30, 40 to be soldered).

The connection case 53 is provided to protect the connecting circuit boards 51 and is, e.g., a molded component formed of a resin. The connection case 53 has a structure easily attached so as to surround the connecting circuit boards 51, e.g., a two-part structure or a structure with hinges.

The connection shield member 52 functions in the same manner as the shielding tapes 32, 42 and the braided wires 33, 43 of the multi-pair cables 3, 4. The connection shield member 52 is provided to surround all portions not covered with the shielding tapes 32, 42 and the braided wires 33, 43 in the connection 5, i.e., to surround the differential signal cables 30 and 40 extending out of the ends of the multi-pair cables 3 and 4 and the connecting circuit boards 51. In this example, the shielding tapes 32, 42 are folded back over the jackets 34, 44 at the ends of the multi-pair cables 3, 4, and the connection shield member 52 is provided so as to be electrically connected to the folded-back portions of the shielding tapes 32, 42.

In addition, in the present embodiment, the connection shield member 52 is provided integrally with the inner surface of the connection case 53. As a result, it is possible to reduce the number of components, and it is also possible to configure so that the connection shield member 52 comes into contact with the folded-back portions of the shielding tapes 32, 42 at the time of attaching the connection case 53, which improves workability during assembly. The connection shield member 52 may be formed of a metal plating applied to the inner surface of the connection case 53, or may be formed of a metal sheet attached to the inner surface of the connection case 53.

However, it is not limited thereto. For example, after forming the connection shield member 52 by winding a metal tape such as aluminum tape, the connection case 53 for protection may be provided therearound.

Alternatively, the connection case 53 may be a molded resin provided to surround the connecting circuit boards 51 and the connection shield member 52. Furthermore, the connector housing 21 and the connection case 53 may be integrated. For example, a molded resin may be provided to cover all the connector substrate 22, the first multi-pair cable 3, the connecting circuit boards 51 and the entire connection shield member 52.

Functions and Effects of the Embodiment

As described above, the differential signal cable assembly in the present embodiment is provided with the connectors 2 to be connected to a communication device, the first multi-pair cables 3 which are connected to the connectors 2 at one end and have plural first differential signal cables 30 for transmitting differential signals, the second multi-pair cables 4 which have plural second differential signal cables 40 having a larger conductor diameter than the first differential signal cable 30, and the connections 5 which are connected to the other ends of the first multi-pair cables 3 and one ends of the second multi-pair cables 4 so that each of the first differential signal cables 30 is electrically connected to the corresponding second differential signal cable 40.

The first multi-pair cables 3 (the first differential signal cables 30) to be connected to the connectors 2 thus can be reduced in diameter and can be connected to the small connectors 2 even when the number of channels is increased. In addition, since the first multi-pair cables 3 (the first differential signal cables 30) have a reduced diameter, the cable in the vicinity of the connectors 2 can be bent easily after the connectors 2 are connected to the communication device and it is thus easy to lay the cable. In addition, by connecting the first multi-pair cables 3 to the second multi-pair cables 4 having a large conductor diameter, it is possible to reduce loss (attenuation of signals) and thereby ensure a sufficient transmission distance.

Modifications

Figure 5A:
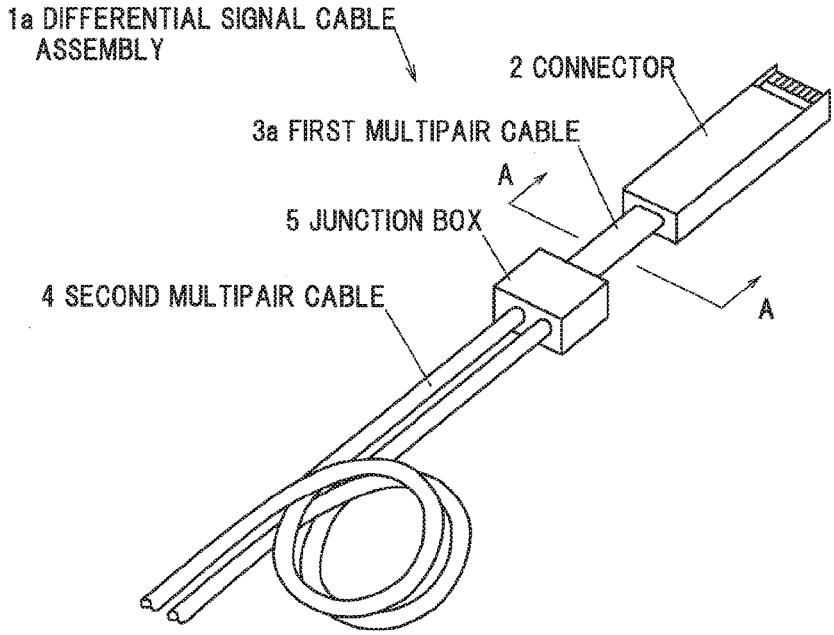
Figure 5B:
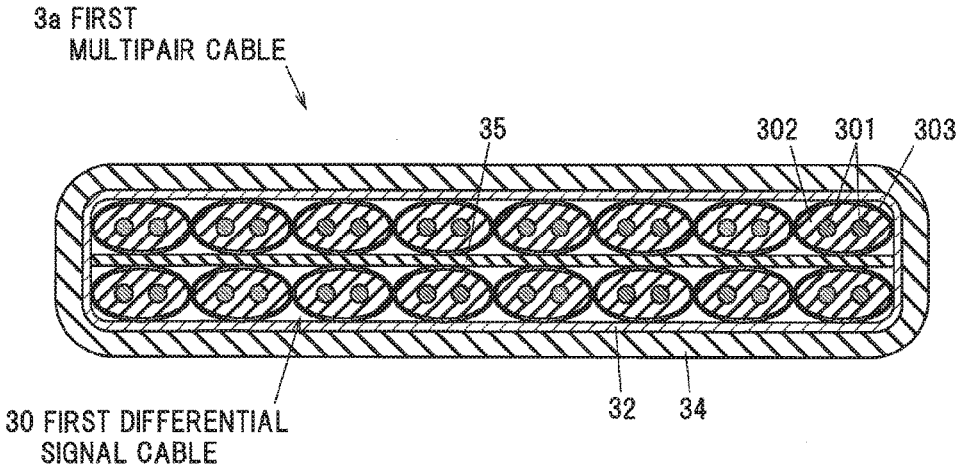

Although the first multi-pair cables 3 each having plural twisted first differential signal cables 30 are used in the embodiment, a first multi-pair cable 3*a* constructed from a flat cable having non-twisted parallel first differential signal cables 30 may be used, as is a cable assembly 1*a* shown in FIGS. 5A and 5B. Although the first multi-pair cable 3*a* used in the example shown in FIG. 5 is a 16-pair flat cable in which two rows (in the minor axis direction of the first insulation 302) of eight first differential signal cables 30 (in the major axis direction) are arranged with a plate-shaped separator (base) 35 between the two rows, for example, two 8-pair flat cables each having two rows of four first differential signal cables 30 may be used.

Figure 6:
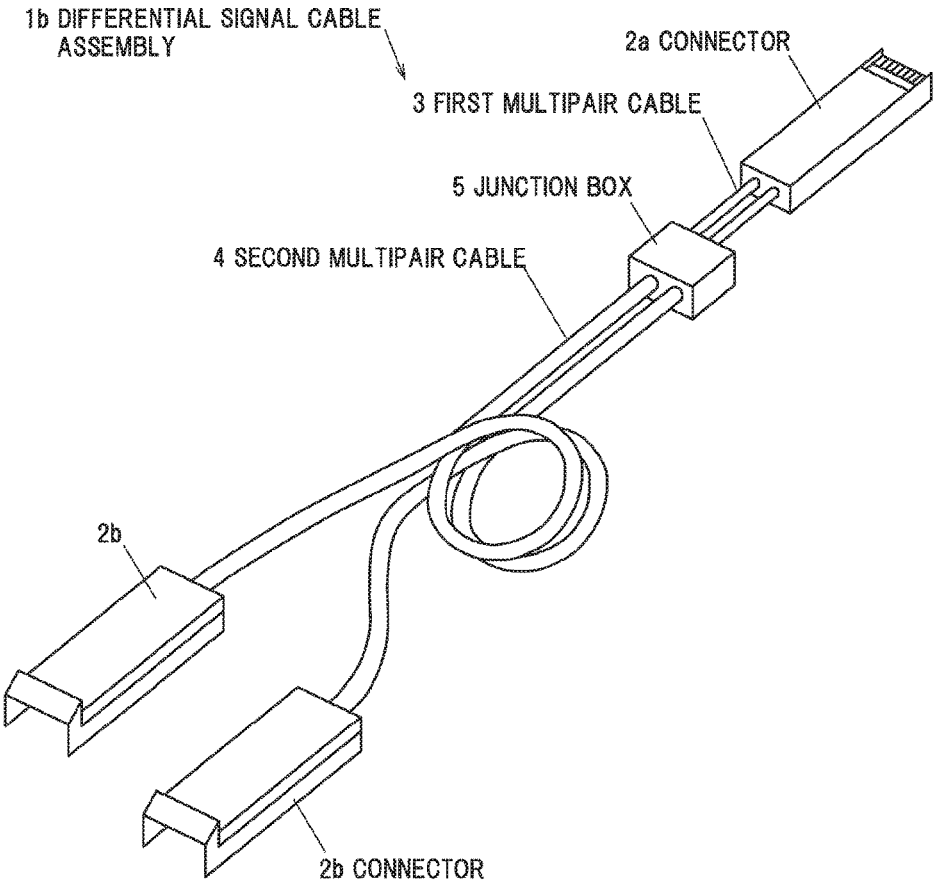
FIG. 6 is a perspective view showing a differential signal cable assembly in another modification of the invention.

In addition, although one connector 2 is provided at each end in the embodiment, the cable may be branched and provided with two or more connectors 2. For example, as is a cable assembly 1*b* shown in FIG. 6, an 8-channel transmit and receive connector 2*a* compliant with the QSFP-DD standard may be provided at one end and two 4-channel transmit and receive connectors 2*b* compliant with the QSFP standard at the other end. In this case, since the number of channels of the connector 2*b* is small, the connection 5 and the first multi-pair cables 3 on the connector 2*b* side are omitted and the second multi-pair cables 4 are directly connected to the connectors 2*b*.

Furthermore, although the connecting circuit boards 51 are used in the connection 5 in the embodiment, the connection 5 may be configured that the signal lines 301, 401 of the differential signal cables 30, 40 are directly connected to each other by welding, etc.

Furthermore, although it is not mentioned in the embodiment, a signal processing circuit such as amplifier circuit may be mounted on the connector substrate 22 of the connector 2.

SUMMARY OF THE EMBODIMENT

Technical ideas understood from the embodiment will be described below citing the reference numerals, etc., used for the embodiment. However, each reference numeral described below is not intended to limit the constituent elements in the claims to the members, etc., specifically described in the embodiment.

[1] A differential signal cable assembly (1), comprising: a connector (2) to be connected to a communication device; a first multi-pair cable (3) that is connected to the connector (2) at one end and comprises a plurality of first differential signal cables (30) for transmitting differential signals; a second multi-pair cable (4) that comprises a plurality of second differential signal cables (40) having a larger conductor diameter than the first differential signal cables (30); and a connection (5) that is connected to an other end of the first multi-pair cables (3) and one end of the second multi-pair cables (4) such that each of the first differential signal cables (30) is electrically connected to a corresponding one of the second differential signal cables (40).

[2] The differential signal cable assembly (1) defined by [1], wherein the conductor diameter of the first differential signal cables (30) is not more than 0.2 mm.

[3] The differential signal cable assembly (1) defined by [2], wherein the conductor diameter of the second differential signal cables (40) is not less than 0.4 mm.

[4] The differential signal cable assembly (1) defined by any one of [1] to [3], wherein the first differential signal cables (30) each comprise a pair of first signal lines (301), a first insulation (302) covering the pair of first signal lines (301), and a first shield (303) comprising a shielding tape that comprises a conductor layer and an insulation layer formed on one surface of the conductor layer and is spirally wound around the first insulation (302).

[5] The differential signal cable assembly (1) defined by [4], wherein the first insulation (302) comprises a fluorine resin.

[6] The differential signal cable assembly (1) defined by any one of [1] to [5], wherein the second differential signal cables (40) each comprise a pair of second signal lines (401), a second insulation (402) covering the pair of second signal lines (401), and a second shield (403) comprising a shielding tape that comprises a conductor layer and an insulation layer formed on one surface of the conductor layer and is longitudinally wrapped around the second insulation (402).

[7] The differential signal cable assembly (1) defined by any one of [1] to [6], wherein the connection (5) comprises a connecting circuit board (51) electrically connecting the first differential signal cables (30) to the second differential signal cables (40), and a connection shield member (52) surrounding the connecting circuit boards (51).

[8] The differential signal cable assembly (1) defined by [7], wherein the connection (5) comprises a connection case (53) for housing the connecting circuit boards (51), and the connection shield member (52) is provided integrally with the connection case (53).

Although the embodiment of the invention has been described, the invention according to claims is not to be limited to the embodiment. Further, please note that all combinations of the features described in the embodiment are not necessary to solve the problem of the invention. In addition, the invention can be appropriately modified and implemented without departing from the gist thereof.

What is claimed is:

1. A differential signal cable assembly, comprising:

a connector to be connected to a communication device;

a first multi-pair cable that is connected to the connector at one end and comprises a plurality of first differential signal cables for transmitting differential signals;

a second multi-pair cable that comprises a plurality of second differential signal cables having a larger conductor diameter than the first differential signal cables; and a connection that is connected to an other end of the first multi-pair cable and one end of the second multi-pair cable such that each of the first differential signal cables is electrically connected to a corresponding one of the second differential signal cables.

2. The differential signal cable assembly according to claim 1, wherein the conductor diameter of the first differential signal cables is not more than 0.2 mm.

3. The differential signal cable assembly according to claim 1, wherein the conductor diameter of the second differential signal cables is not less than 0.4 mm.

4. The differential signal cable assembly according to claim 1, wherein the first differential signal cables each comprise a pair of first signal lines, a first insulation covering the pair of first signal lines, and a first shield comprising a shielding tape that comprises a conductor layer and an insulation layer formed on one surface of the conductor layer and is spirally wound around the first insulation.

5. The differential signal cable assembly according to claim 1, wherein the first insulation comprises a fluorine resin.

6. The differential signal cable assembly according to claim 1, wherein the second differential signal cables each comprise a pair of second signal lines, a second insulation covering the pair of second signal lines, and a second shield comprising a shielding tape that comprises a conductor layer and an insulation layer formed on one surface of the conductor layer and is longitudinally wrapped around the second insulation.

7. The differential signal cable assembly according to claim 1, wherein the connection comprises a connecting circuit board electrically connecting the first differential signal cables to the second differential signal cables, and a connection shield member surrounding the connecting circuit boards.

8. The differential signal cable assembly according to claim 7, wherein the connection comprises a connection case for housing the connecting circuit board, and the connection shield member is provided integrally with the connection case.

* * * * *